US007963084B2

(12) United States Patent
Merrifield et al.

(10) Patent No.: US 7,963,084 B2
(45) Date of Patent: Jun. 21, 2011

(54) DEPLOYABLE TRIANGULAR TRUSS BEAM WITH ORTHOGONALLY-HINGED FOLDING DIAGONALS

(76) Inventors: Donald Merrifield, Smyrna, TN (US); James W. Fletcher, Cape Canaveral, FL (US)

( * ) Notice: Subject to any disclaimer, the term of this patent is extended or adjusted under 35 U.S.C. 154(b) by 1065 days.

(21) Appl. No.: 11/468,286

(22) Filed: Aug. 29, 2006

(65) Prior Publication Data

US 2007/0044415 A1 Mar. 1, 2007

Related U.S. Application Data

(60) Provisional application No. 60/711,670, filed on Aug. 29, 2005.

(51) Int. Cl.
*E04H 12/10* (2006.01)
*E04H 12/18* (2006.01)

(52) U.S. Cl. ..... 52/646; 52/652.1; 52/653.1; 52/645; 52/117

(58) Field of Classification Search ..... 52/652.1, 52/653.1, 653.2, 641, 643, 645, 646, 117, 52/110

See application file for complete search history.

(56) References Cited

U.S. PATENT DOCUMENTS

| | | | | |
|---|---|---|---|---|
| 2,060,436 | A | 11/1936 | Wetzel | |
| 3,094,847 | A | 6/1963 | Pogonowski | |
| 3,220,152 | A | 11/1965 | Sturm | |
| 3,354,591 | A * | 11/1967 | Fuller | 52/81.2 |
| 3,751,863 | A | 8/1973 | Lyons | |
| 3,771,274 | A | 11/1973 | Vaughan | |
| 3,783,573 | A * | 1/1974 | Vaughan | 52/646 |
| 3,902,289 | A | 9/1975 | Dashew | |
| 4,259,821 | A * | 4/1981 | Bush | 52/309.1 |
| 4,276,726 | A * | 7/1981 | Derus | 52/109 |
| 4,334,391 | A | 6/1982 | Hedgepeth et al. | |
| 4,337,560 | A | 7/1982 | Slysh | |
| 4,471,548 | A * | 9/1984 | Goudie | 40/610 |
| 4,475,323 | A | 10/1984 | Schwartzberg et al. | |
| 4,524,552 | A | 6/1985 | Hujsak | |
| 4,539,786 | A * | 9/1985 | Nelson | 52/645 |
| 4,557,097 | A * | 12/1985 | Mikulas et al. | 52/646 |
| 4,569,176 | A * | 2/1986 | Hedgepeth et al. | 52/645 |
| 4,587,777 | A | 5/1986 | Vasques et al. | |
| 4,633,566 | A | 1/1987 | Coppa | |
| 4,646,994 | A | 3/1987 | Petersen et al. | |
| 4,655,022 | A * | 4/1987 | Natori | 52/646 |
| 4,662,130 | A | 5/1987 | Miura et al. | |
| 4,667,451 | A | 5/1987 | Onoda | |
| 4,677,803 | A | 7/1987 | Mikulas, Jr. et al. | |

(Continued)

FOREIGN PATENT DOCUMENTS

| | | |
|---|---|---|
| GB | 2 063 959 | 6/1981 |

(Continued)

*Primary Examiner* — Phi D. A

(74) *Attorney, Agent, or Firm* — W. Edward Ramage; Baker Donelson

(57) ABSTRACT

A synchronously deployable tetrahedral truss beam with orthogonally-hinged diagonals, having uniquely-connected transverse members and folding chordal members, where a plurality of bays can extend and retract in a coordinated manner without need for a deployment canister mechanism or other assembling means. The triangular cross-section truss can be adapted to deploy pre-attached panels or nodally-attached payload components. These triangular beams can be mounted side-by-side with a common chord to create a synchronously deployable trapezoidal cross-section beam or space-frame. Both the triangular and trapezoidal configurations can be adapted to deploy with a prescribed curvature of the longitudinal axis, and form perimeter trusses which can be post-tensioned for maximum structural performance.

17 Claims, 13 Drawing Sheets

U.S. PATENT DOCUMENTS 4,679,961 A 7/1987 Stewart
4,697,767 A 10/1987 Witten et al.
4,722,162 A * 2/1988 Wilensky ..... 52/652.1
4,745,725 A 5/1988 Onoda
4,763,459 A 8/1988 Wesselski
4,765,114 A * 8/1988 Wesselski ..... 52/646
4,771,585 A * 9/1988 Onoda et al. ..... 52/646
4,805,368 A 2/1989 Wesselski
4,819,399 A 4/1989 Onoda
4,829,739 A 5/1989 Coppa
4,878,286 A 11/1989 Coppa
4,930,930 A * 6/1990 Coppa ..... 403/171
4,958,474 A 9/1990 Adams
RE33,438 E 11/1990 Stewart
5,016,418 A * 5/1991 Rhodes et al. ..... 52/646
5,040,349 A * 8/1991 Onoda et al. ..... 52/646
5,085,018 A 2/1992 Kitamura et al.
5,125,206 A * 6/1992 Motohashi et al. ..... 52/646
5,154,027 A 10/1992 Warden
5,163,262 A 11/1992 Adams
5,184,444 A 2/1993 Warden
5,267,424 A 12/1993 Douglas
5,356,234 A 10/1994 Vangool
5,407,152 A 4/1995 Pelischek et al.
5,651,228 A 7/1997 Zeigler
5,701,713 A 12/1997 Silver
5,761,871 A 6/1998 Atake
5,822,945 A 10/1998 Muller
5,857,648 A 1/1999 Dailey et al.
6,038,736 A * 3/2000 Nygren ..... 16/275
6,076,770 A * 6/2000 Nygren et al. ..... 244/159.5
6,082,056 A 7/2000 Hoberman
6,158,187 A 12/2000 Nakajima
6,161,359 A 12/2000 Ono
6,286,282 B1 * 9/2001 Castano ..... 52/653.2
6,321,501 B1 11/2001 Ignash
6,343,442 B1 2/2002 Marks
6,345,482 B1 2/2002 Warren
6,499,266 B1 12/2002 Macumber
6,887,009 B1 * 5/2005 Lopez ..... 403/171
6,920,722 B2 7/2005 Brown et al.
7,028,442 B2 4/2006 Merrifield
2002/0112417 A1 8/2002 Brown et al.
2005/0126106 A1 6/2005 Murphy et al.
2005/0144884 A1 7/2005 Moriya

FOREIGN PATENT DOCUMENTS

JP 3103573 4/1991

* cited by examiner

DEPLOYABLE TRIANGULAR TRUSS BEAM WITH ORTHOGONALLY-HINGED FOLDING DIAGONALS

RELATED APPLICATION

This application claims the benefit of and priority to U.S. Provisional Application Ser. No. 60/711,670, filed Aug. 29, 2005, the contents of which are incorporated by reference herein in its entirety.

FIELD OF THE INVENTION

The present invention generally relates to deployable triangularly-shaped truss systems, and more particularly discloses triangular truss systems having joints that allow for uniform and synchronous retraction and extension of triangularly shaped truss beams.

BACKGROUND OF THE INVENTION

There have been many attempts to design a practical, compact, folding or flexible truss system which can transition easily between retracted and extended states when the truss system is situated in varying operating environments. Prior art truss systems were designed to exhibit specific characteristics including low size/volume ratio; high kinematic stability; simplicity and reliability; high compactability; or high structural efficiency in terms of weight, complexity, auxiliary mechanism requirements, manufacturing costs, speed of operation or operating costs. Typically, truss systems disclosed in the prior art lack an optimal combination of features. Further, some prior art trusses have undesirable characteristics including undue complexity; inability to move in a coordinated and synchronous manner; requirements for a dedicated deployer; lack of compactability, reconfigurability, and multi-functional uses; and high costs. Relatively few designs have appeared in the marketplace that have been able to incorporate desirable design features, avoid undesirable features, and reduce the complexity of the chordal and section members of the truss system. Fewer still are capable of multiple uses and of deployment in multiple gravitational or operational environments.

For example, U.S. Pat. No. 3,783,573 to Vaughn ("Vaughn") discloses many of the desired characteristics listed above but also includes some of the undesirable characteristics. Vaughn discloses frame sets and frame bays in a parallelogram configuration that includes extra chords and members that make the design overly complex, increasing the number of components that could fail to extend or retract. Further, Vaughn discloses that collapsing the structure requires the disconnection of the structural bays from each other and the collapse of each bay separately. Thus, Vaughn's system fails to act in a continuous and synchronous manner.

One advance in the art is represented in U.S. Pat. No. 7,028,442, to Merrifield, (the "442 patent"), the teachings of which are incorporated herein by reference. The '442 patent discloses a deployable square or rectangular configured truss with many desirable characteristics. The '442 patent does not disclose, however, the triangular configuration of the present invention, which possesses distinct characteristics and advantages.

There is a continuing need for improved deployable triangular truss systems that achieve synchronous coordinated motion of all members while extending or retracting, are stable, and do not require dedicated auxiliary mechanisms and structures to function, so that the overall deployable system remains compactable and low in weight, and has both reduced complexity and cost.

SUMMARY

Accordingly, the present invention is directed to deployable triangular truss beam systems with orthogonally-hinged folding diagonal members that substantially eliminate one or more of the limitations and disadvantages of the related art.

An object of the present invention is to provide an apparatus and method in which triangular, and double triangular trusses can be expanded from a compact form.

Another object of the present invention is to provide three-dimensional triangular trusses having few complex parts, wherein the trusses can be deployed and retracted in a stable, synchronous manner in a variety of combinations to form load bearing beams, masts, platforms, frameworks or other structures while reducing the number of folding chords and chordal members that are required.

Still another object of the present invention is to provide a means for the formation of either linear or curved triangular trusses, wherein the trusses have rectangular or planar faces useful for optional deployment of panels to serve a specified function.

Yet another object of the present invention is to create a triangular truss configuration which can be erected or deployed readily into curved beams or perimeter trusses, wherein the perimeter trusses can be post-tensioned for preloading and high stiffness without preloading of the individual joints for trusses of linear or curved segments.

It is still another object of the invention to permit triangular truss beams to be mounted side-by-side with a common chord to form a double triangular truss configuration.

When employed in a single embodiment, these objects create a stable triangular truss that achieves a synchronous, coordinated motion of its members while extending and retracting. The triangular truss in such an embodiment also preferably does not require dedicated auxiliary mechanisms to function, and is therefore lower in weight, compactable, and low in both complexity and cost.

These and other objects are preferably accomplished by providing a deployable triangular truss beam with proximal and distal ends, comprising a plurality of framesets, each frameset having a first diagonal side member, a second diagonal side member, and a transverse member, each of said diagonal side members and said transverse member having a first and a second end, said first diagonal side member being hingedly connected at its first end adjacent to the first end of said second diagonal side member at a primary joint and the second end of said first diagonal side member being hingedly connected to the first end of said transverse member at a first secondary joint, the second end of said transverse member being hingedly connected to the second end of said second diagonal side member, at a second secondary joint, a plurality of framebay subassemblies, each framebay subassembly comprising a first and second frameset, one of said framesets being connected to another of said framesets by a diagonal member connecting the second end of said second diagonal member at its connection to the second end of said transverse member to the primary joint of a first frameset, and said one of said framesets also being connected to another of said framesets by a diagonal member connecting the second end of said first diagonal member at its connection to the first end of said transverse member to the last mentioned primary joint thereby forming a framebay subassembly. A plurality of framebays, each framebay comprising a framebay subassembly, is provided having a first primary chord connected to the primary joints of the framesets comprising the framebay subassembly, a first secondary chord connected to the second ends of said first diagonal side members of the first and second framesets comprising the framebay subassemblies at their points of connection to the first ends of said transverse members, and a second secondary chord connected to the second ends of said second diagonal side members of the first and second framesets comprising the framebay subassemblies at their points of connection to the second ends of said transverse members. All of the joints are separable into two interconnected mating parts and have hinge means thereon for folding said chords and said diagonal members from a first deployed position to a second retracted position.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of at least one embodiment of the invention.

In the drawings.

DETAILED DESCRIPTION OF THE PREFERRED EMBODIMENTS

Reference will now be made in detail to embodiments of the present invention, examples of which are illustrated in the accompanying drawings.

FIGS. 1-4 disclose the general configuration of an embodiment of a two-bay portion of a basic single triangular deployable truss beam in an extended or deployed state. In the embodiment illustrated in FIGS. 1 to 4, the deployed portion of truss beam 100 is comprised of a series of planar trusses in a Warren pattern. The illustrated embodiment provides a triangle-shaped truss wherein three truss chords, Chord A, Chord B, and Chord C (see FIG. 2), form longitudinal chords. Chord A is a chord that connects base joints 120 of individual truss segments as illustrated in FIGS. 1-4. Chord A, also referred to herein as the "Apex chord", can also connect to an end mount frame (not shown) as discussed in U.S. Pat. No. 7,028,442. The two other longitudinal chords, Chords B and C, are also oriented substantially along the truss beam's longitudinal axis and each chord connects secondary joints 125B, 125C for the truss segments (joints 125B for Chord B and joints 125C for Chord C). Chords B and C can also connect to the end mount frame (not shown).

Chords A, B and C can be comprised of component members, referred to as primary chordal members 101 (Chord A) and secondary chordal members 102 (Chords B & C). Primary chordal members 101 and secondary chordal members 102 may be compression structures or tension structures depending on the structural needs and compacting requirements of the truss system. Compression chord members may be rigid members that are affixed to the truss after extension or deployment or hinged to fold during truss retraction. Tension chord members can be flexible, hinged, pressure formed or use cables. For the purposes of clarity, it is assumed herein that Chords A, B and C use folding members. However, it should be apparent to one skilled in the art that alternative member arrangements can be substituted therefor without departing from the spirit or the scope of the invention.

Figure 1:
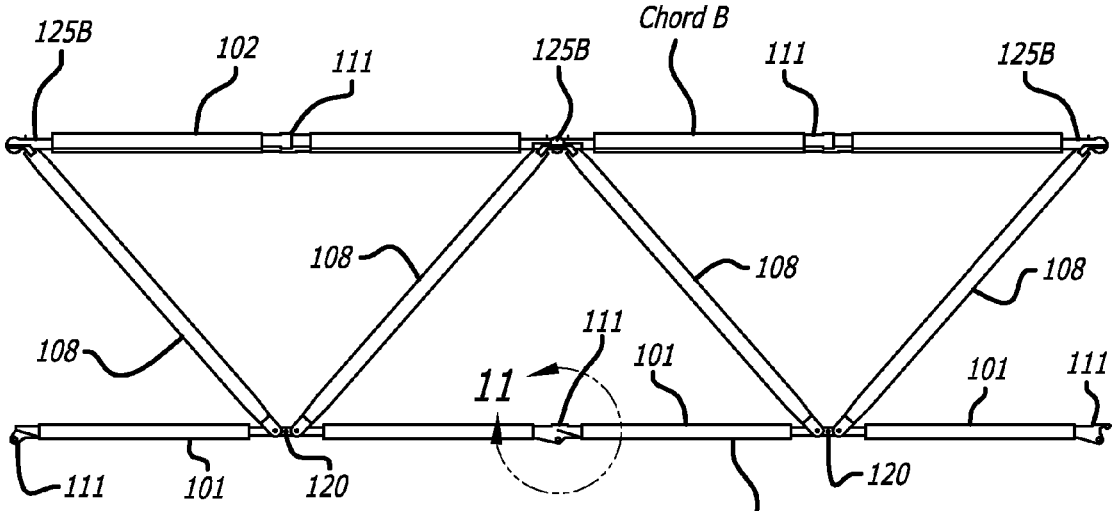
FIG. 1 is a side view of a fully extended triangular truss beam with two identical framebays (bays).

Thus, triangularly shaped truss beam 100 is shown in FIG. 1 in the deployed state and comprised of a primary Chord A and 2 secondary Chords B and C. Each Chord A, B and C is comprised of a plurality of chordal members. Thus, Chord A is comprised of a plurality of primary chordal members 101 and Chords B and C are comprised of a plurality of secondary chordal members 102.

Figure 2:
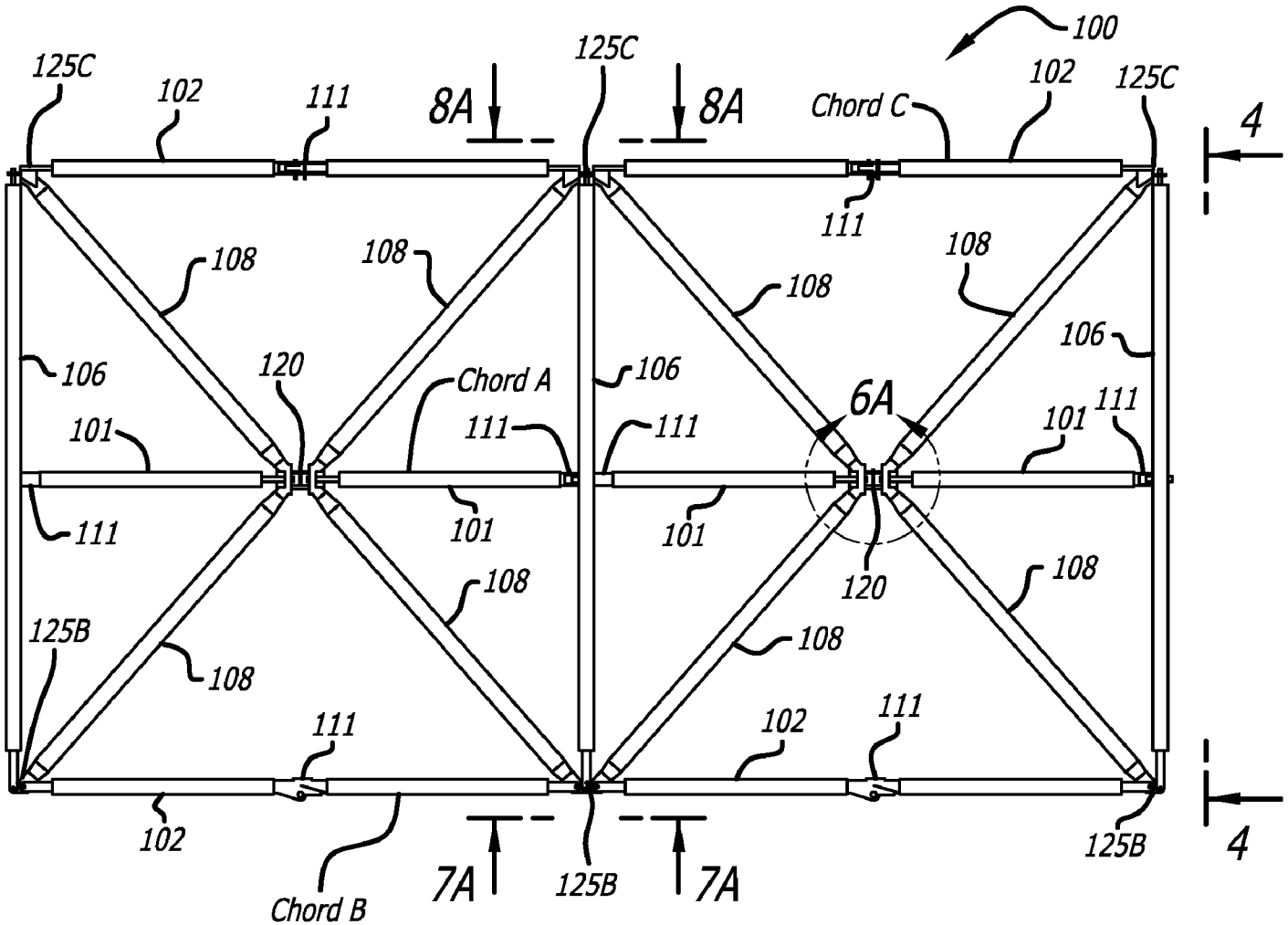
FIG. 2 is a top view of the fully extended triangular truss beam of FIG. 1.

In FIGS. 1 and 2, diagonal members 108 connect primary joints 120 to secondary joints 125B, 125C, as illustrated. Transverse members 106 connect secondary joints 125B and 125C as illustrated. Chordal members 102 connect like secondary joints. For example, chordal members 102 in secondary chordal member C in FIG. 2 connect secondary joint 125C at top left to secondary joint 125C at the top middle, then to secondary joint 125C at top right. Chordal members 102 in secondary chordal member B connection secondary joint 125B (bottom left) to bottom middle secondary joint 125B, then to the end second joint 125B (bottom right). Chordal members 101 in primary chordal member A connect primary joints 120 as seen in FIG. 2. Thus, all chordal members 101, 102 connect like joints; that is, secondary joint 125B connects to another secondary joint 125B, secondary joint 125C connects to another secondary joint 125C, primary joint 120 connects to another primary joint 120, etc.

As shown in FIGS. 1 and 2, certain of the chordal members 101, 102 are hinged at chordal hinges 111, as shown. Also, as will be discussed, certain of the joints, such as at the ends of the structure shown in FIGS. 1 and 2, may terminate in ½ of a joint for subsequent connection to a mating joint half on another truss bay.

Transverse members 106 (FIG. 2) act as struts, increasing the structural stability of truss beam 100. Transverse members 106 are preferably situated perpendicular to the truss longitudinal axis to further increase the structural stability of truss beam 100. Primary chordal members 101 and secondary chordal members 102 can also be attached in the longitudinal axis of truss beam 100 via the various joints. All chordal members can be knife-edge (male clevis end) configured for better load transfer.

Figure 3:
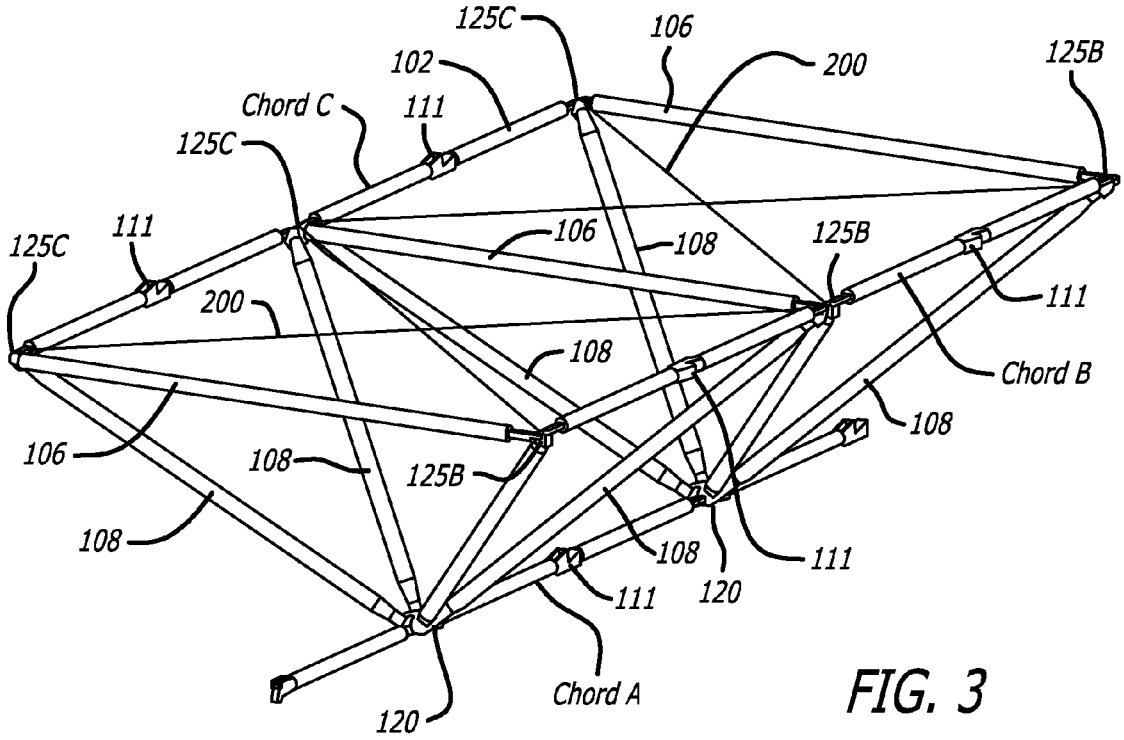
FIG. 3 is a front perspective view of the fully extended triangular truss beam of FIGS. 1 and 2.

In an alternative embodiment, as seen in FIG. 3, secondary joints 125B and 125C may also be connected by flexible cross-diagonals 200 for increased torsional rigidity. Flexible cross-diagonals 200 are preferably coplanar with Chords B and C. The flexible cross-diagonals 200 are preferably connected from one secondary joint, such as secondary joint 125B, to a diagonally opposite secondary joint 125C. Moreover, given the flexible nature of the cross-diagonals 200, they should preferably collapse in a scissor pattern when truss beam 100 retracts.

Secondary joints 125B and 125C may also optionally have preloaded features to enable higher stiffness with zero free play. During extension, the triangularly shaped bays preferably remain aligned to each other by the action of the joints, as described below. In this embodiment, the hinge axes of secondary joints 125B and 125C are orthogonal with respect to primary chordal members 101 and secondary chordal members 102 when comparing truss beam 100 in its retracted and deployed states. The use of compression chordal members permits bidirectional beam moment loading.

Figure 4:
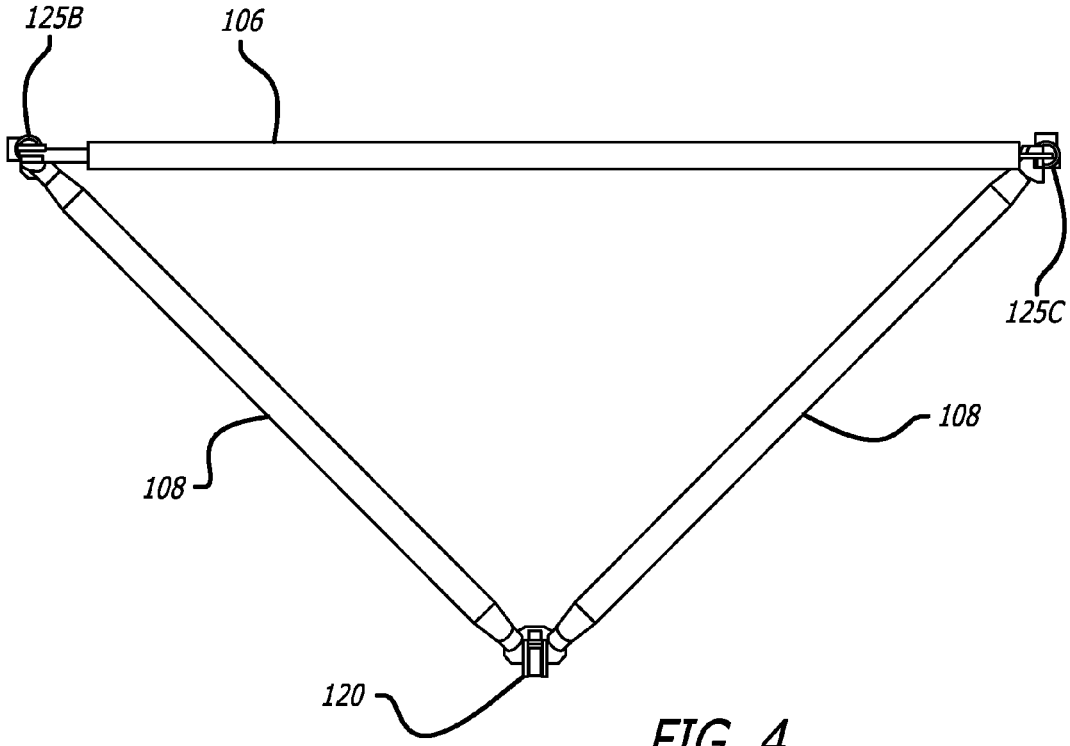
FIG. 4 is an end view of the truss beam of FIGS. 1 to 3.

FIG. 4 also illustrates a single frameset with two diagonal members 108 connected to joints 125A and B, respectively. These diagonal members 108 extend to and are connected to primary joint 120.

Figure 10:
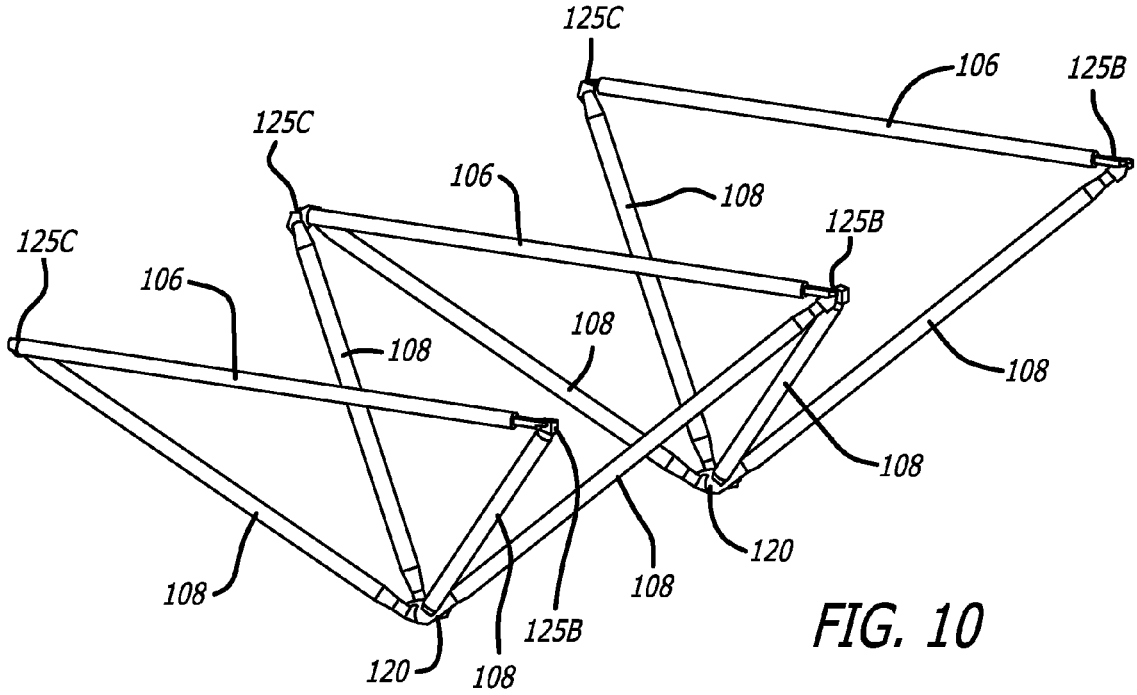
FIG. 10 is a perspective view illustrating the interconnection of 4 framesets as shown in FIG. 3.

As seen in FIG. 10, which shows 4 framesets, without chords, with diagonal members 108 connecting one half of a secondary joint 125B and one half of a secondary joint 125C, respectively, with primary joint 120. A first end of one diagonal member 108 is connected to one half of a secondary joint 125B. The opposite end of that diagonal member 108 connects to the primary joint 120 of another truss segment or frameset at the primary joint of that other segment or frameset. Similarly, another diagonal member 108 is connected to base joint 120 and has an opposite end that connects to another truss segment or frameset at a secondary joint. Although not illustrated in FIG. 10, it should be apparent that a primary chordal member 101 can be used to join primary joint 120. A secondary chordal member 102 can be used to join the respective secondary joints 125B and 125C.

Secondary joints 125B and 125C can connect to other components via lugs or equivalent connectors (e.g., an end frame or mount structure). The connectors preferably provide a hinge pin connection for the longitudinal chordal members such that, when truss beam 100 is in an extended position, the joint hinge pins in each chord are coplanar and lie on the chordal axis as discussed in Merrifield U.S. Pat. No. 7,028,442. Thus, 2 framesets form a frameset subassembly and the addition of Chords A, B & C to a plurality of frameset subassemblies form a framebay such as shown in FIG. 3.

In its basic form the invention can be used as a beam, mast, or the framework for a wide variety of applications in low and zero gravity environments and at-normal gravity. As a beam, it may be cantilevered or may be supported or mounted at each end of the beam. As a mast, it is may be base-mounted with support from guy cables or equivalent. The truss system may also be used as the framework for larger structures that may be affixed to the truss beam.

The truss system can use power actuated folding chordal members to cause the continuous, synchronous motion of the truss system during extension and retraction. Hinged chordal members may also lock passively during extension of the truss system. The locking may be accomplished by a spring lock or equivalent manner. A minimum amount of force may be required to cause the unlocking and initial rotation of the joints prior to retraction of the full assembly. For a fully automated or semi-automated operation, there may be a need for actuators whose selection will be dependent on the specific requirements of a given truss beam application.

In some embodiments, if gravity loading is not present or if the truss frames are supported by rollers or equivalent, a method of deployment may include the application of an axial force at the end frame. The axial force will be used to extend or retract the truss system. At full extension of the truss system, the chordal members, if hinged, are spring locked. When a truss system is fully extended in the deployed position, for the system to retract, any hinged or locked chordal members need to be unlocked and given an initial force.

When extending and retracting the truss system on level or inclined surfaces, low friction caster wheels attached to the primary hinge joints may be used to support the truss frame. If there is no support surface to support the truss system, various cable and winch mechanisms may be utilized to aid in deployment and retraction of the truss system.

Truss systems may also be designed to cover a span, wherein multiple truss systems are configured having at least two separate trusses located at opposite ends of the span. Each truss deploys and extends from their side across the span. Once the chordal members lock, the ends of each truss maybe aligned and a locking mechanism located at the ends of each truss will fasten together the two trusses across the span.

Figure 5A:
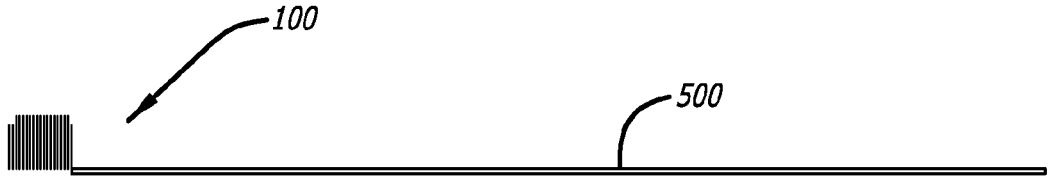
FIGS. 5A-5C illustrate deploying of a curved truss beam embodiment from its compacted or retracted state to its fully formed, curved state.
Figure 5B:
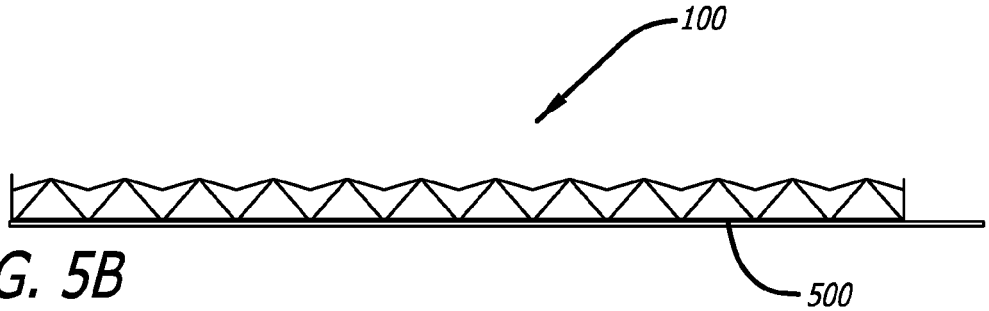
Figure 5C:
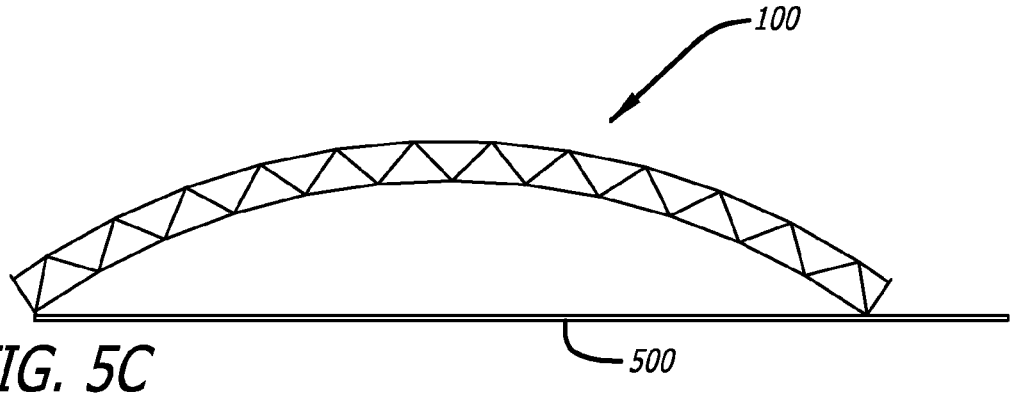

As seen in FIG. 5A, a triangularly shaped truss beam 100 with a plurality of bays is shown in a retracted position, associated with a surface 500. FIG. 5B illustrates the deployed position of beam 100 along surface 500. FIG. 5C illustrates the curvature of beam 100 with respect to surface 500. That is, the truss beam 100 extends out in a linear fashion and conventional actuators, known in the art, located along the longitudinal chords of the truss beam 100, react mechanically to curve truss beam 100 into an arc as illustrated in FIG. 5C.

Figure 6A:
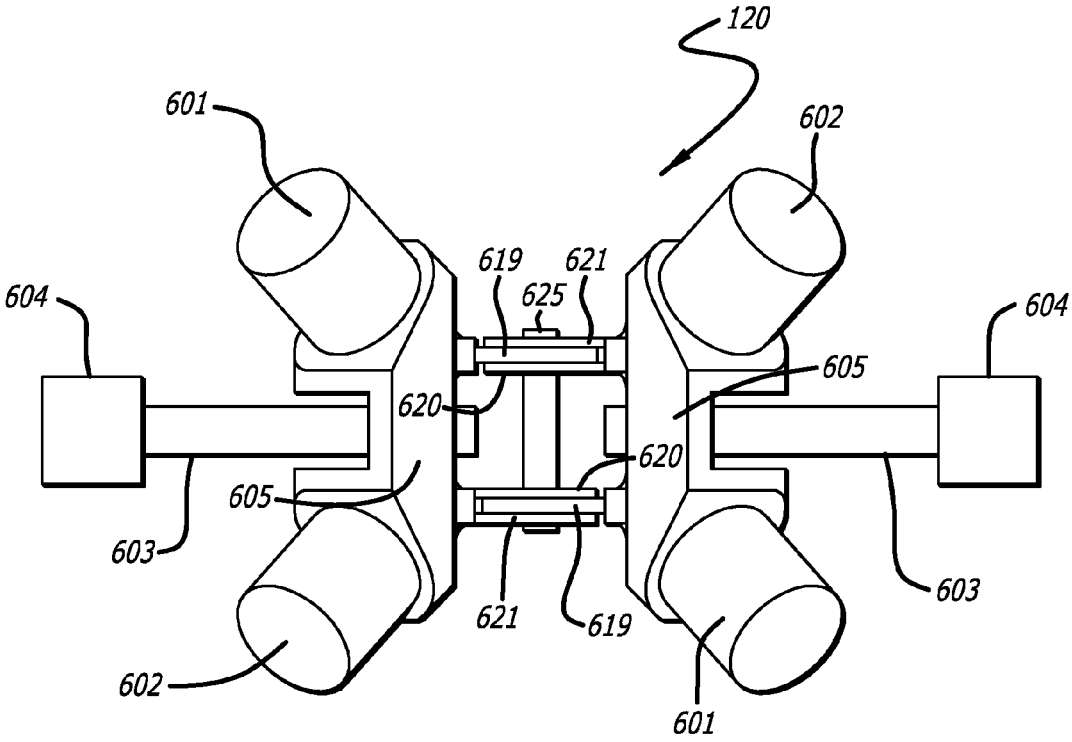
FIG. 6A is a top view of a primary joint in accordance with the teachings of the invention.
Figure 6B:
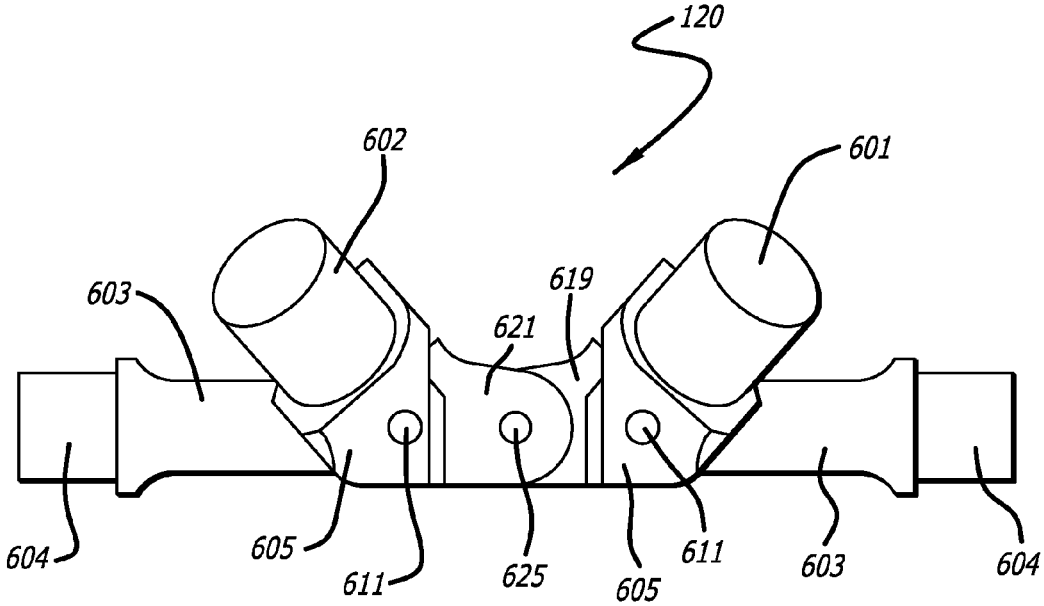
FIG. 6B is a side view of the joint of FIG. 6A.

Primary joint 120 is shown in FIGS. 6A and 6B. Joint 120 comprises two identical fitting halves 605, each with 2 diagonal connector ends 601, 602. Ends 601, 602 connect to diagonal members 108, whereas chordal end fitting 603 with end connector 604 is connected to a primary chordal member 101. Member 603 is pivotally connected to fitting half 605 at pivot pin 611 (FIG. 6B).

Fitting half 605 is hinged to an identical fitting half having diagonal connector ends 601, 602 extending outwardly at an angle as shown. Chordal end fitting 603 is pivotally connected at pivot pin 611 (FIG. 6B) and connected to a primary chordal member 101. Ends 601, 602 connect to diagonal members 108 as shown in FIG. 2.

As seen in FIG. 6A, male clevis lug member 619 extends from fitting half 605 into a space formed between female clevis lugs 620, 621 extending from the opposing (second) fitting half. In like manner, a male clevis lug 619 extends from the second fitting half 605 into a space formed between 620, 621 on the first fitting half 605. A hinge pin 625 (FIG. 6B) extends between each 619, 620, 621 couple, so that both fitting halves rotate about pin 625.

Figure 7A:
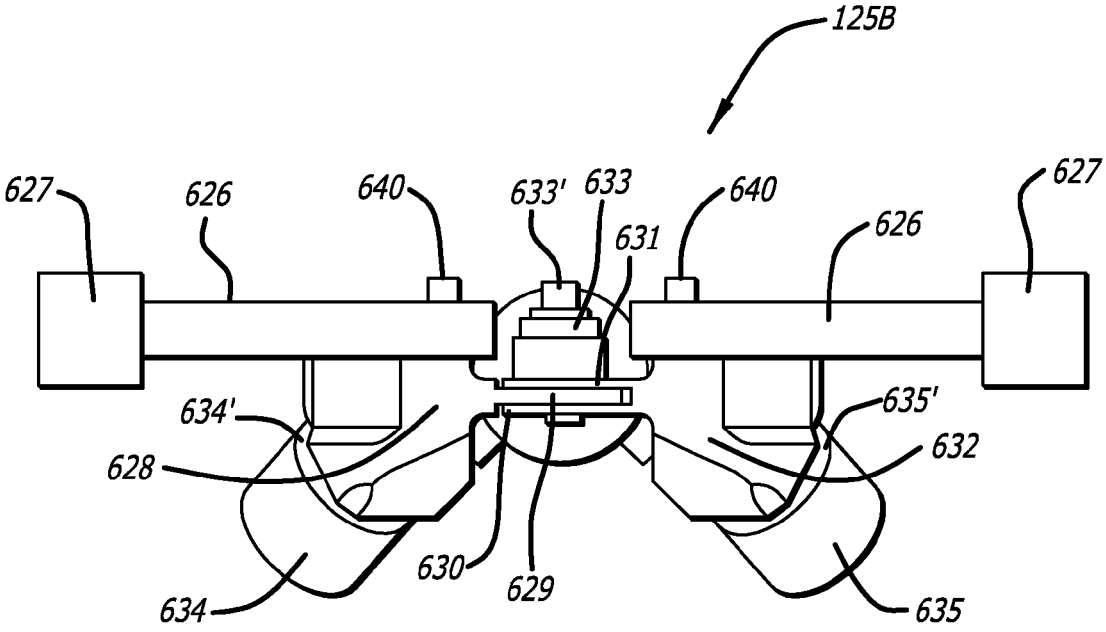
FIG. 7A is a view of a secondary joint in accordance with the teachings of the invention, taken along lines 7A-7A of FIG. 2.
Figure 7B:
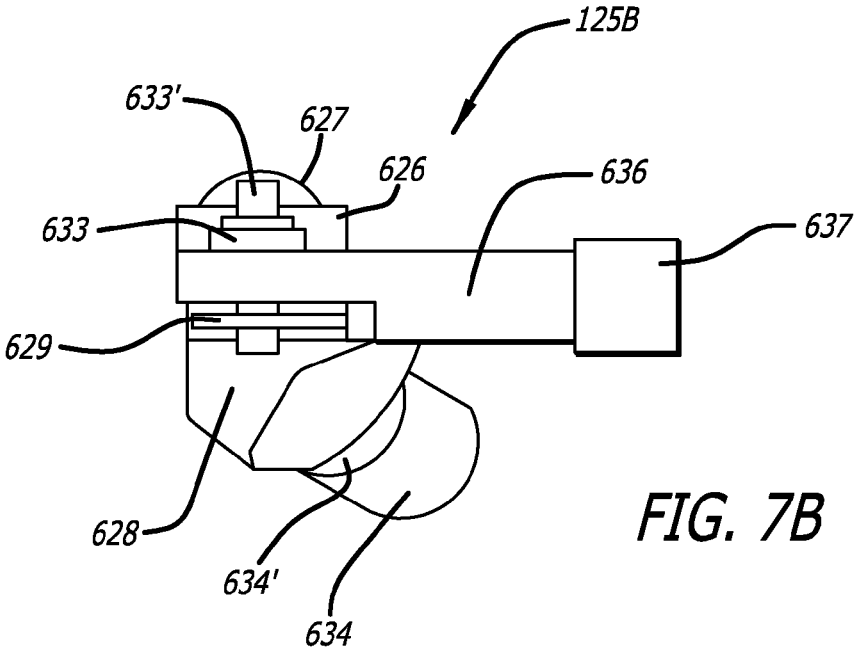
FIG. 7B is a right end elevation view of the joint of FIG. 7A, parts thereof being omitted for convenience of illustration.

Secondary joint 125B is shown in FIGS. 7A and 7B. Hinge fitting halves 628 and 632 are derived from the fitting halves of primary joint 120 just described (FIG. 6A). Half of each fitting half is removed, leaving what is shown in FIG. 7A as fittings 628 and 632. Diagonal connector ends 634 and 635 are similar to those for joint 120 except that each connector incorporates rotation joints 634' and 635' for rotatable connection to diagonals 108 (as is taught in the 442 patent). Fitting halves 628 and 632 are hinged together through a clevis lug couple comprised of a male clevis lug 629 extending between spaced female lugs 630, 631, the same as was described for primary joint 120, and the chordal end fittings 626 having end connectors 627 are pivotally connected as for joint 120 at pins 640. A principal difference is that joint 125B connects one end 636 (FIG. 7B) of transverse member 106 to the main hinge pin 633' through spherical bearing 633 mounted in the end of 106 as shown in FIG. 7A, which allows necessary freedom of motion during truss extension and retraction. The end fitting member 636, which contains spherical bearing 633, is notched as shown in FIG. 7B to permit members 626 to fold parallel to transverse member 106 when the truss collapses/retracts. Thus, secondary joint 125B can be derived from primary joint 120, but provides for proper connection of transverse member 106, and provides for rotatable connection of diagonals 108.

Figure 8A:
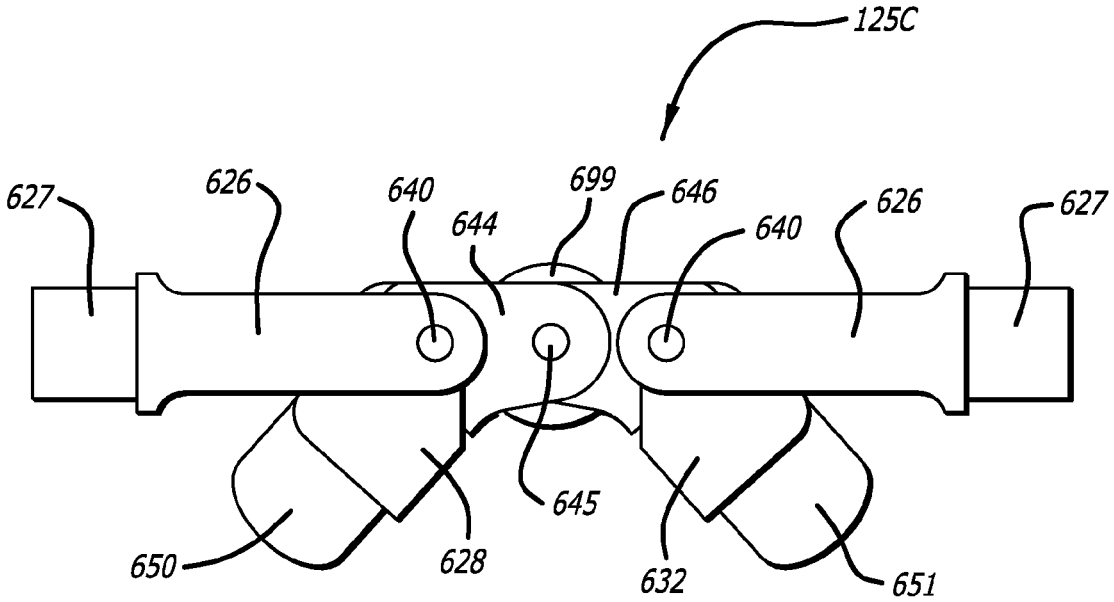
FIG. 8A is a view of a secondary joint in accordance with the teachings of the invention taken along lines 8A-8A of FIG. 2.
Figure 8B:
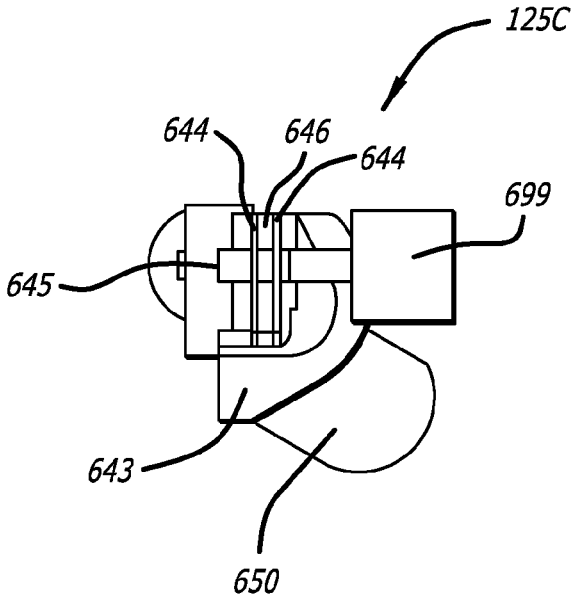
FIG. 8B is a right side view of the joint of FIG. 8A.

Secondary joint 125C is shown in FIGS. 8A and 8B. The construction of this joint is similar to joint 125B except that it is oriented 90 degrees to 125B, does not provide for a spherical bearing connection to transverse member 106, and does not require rotational connection of diagonals 108. Like numerals refer to like parts of FIGS. 7A and 7B. It provides for member 106 (at end 699) to be connected directly to main hinge pin 645 as shown in FIG. 8B. Connectors 650, 651 do not rotate and fitting 699 is the end fitting for transverse member 106. Chordal end fittings 626 having end connectors 627 are pivotally connected at pins 640 as in joint 125B.

Figure 11:
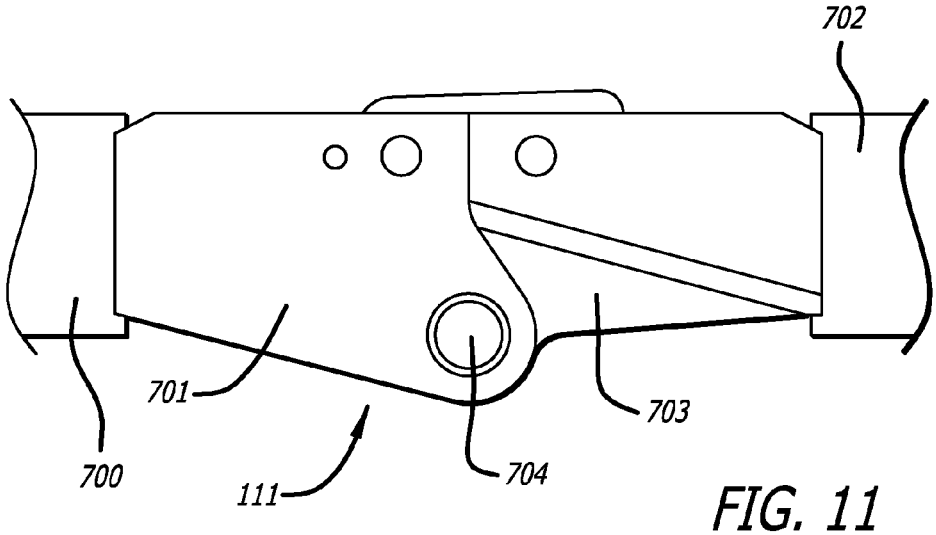
FIG. 11 is a side view of a folding hinge.

Folding hinge 111 is shown in FIG. 11. Each folding hinge 111 has a first chordal member connector 700 at one end integral with a female yoke portion 701. A second chordal member connector 702 has a male extension portion 703 extending between yoke portion 701 and pivotally connected thereto by pivot pin 704.

Figure 9:
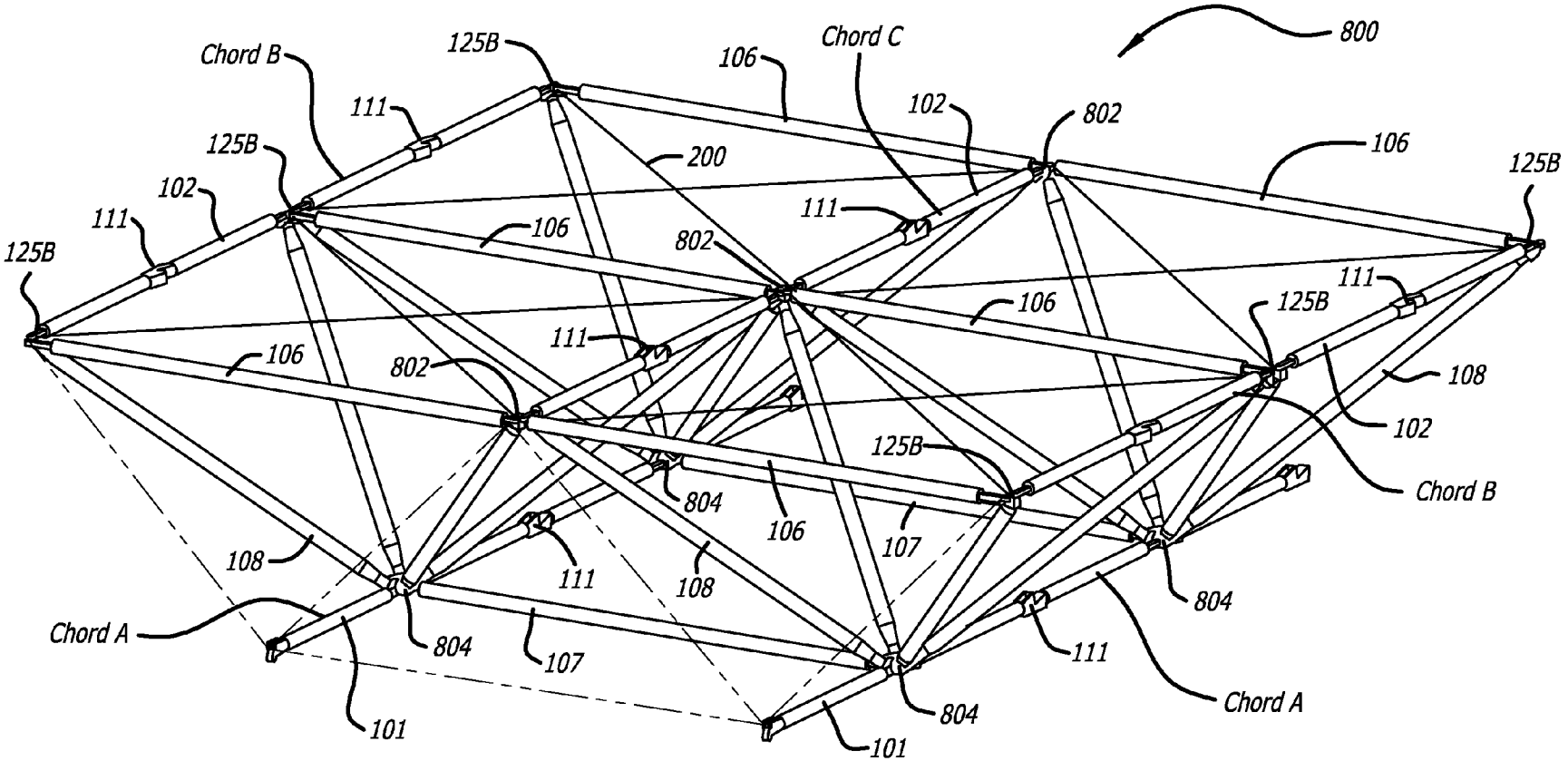
FIG. 9 is a perspective view illustrating how 2 triangular truss beams, as in FIGS. 1 to 3, can be connected in a side-to-side relationship to form a double triangular truss beam.
Figure 12:
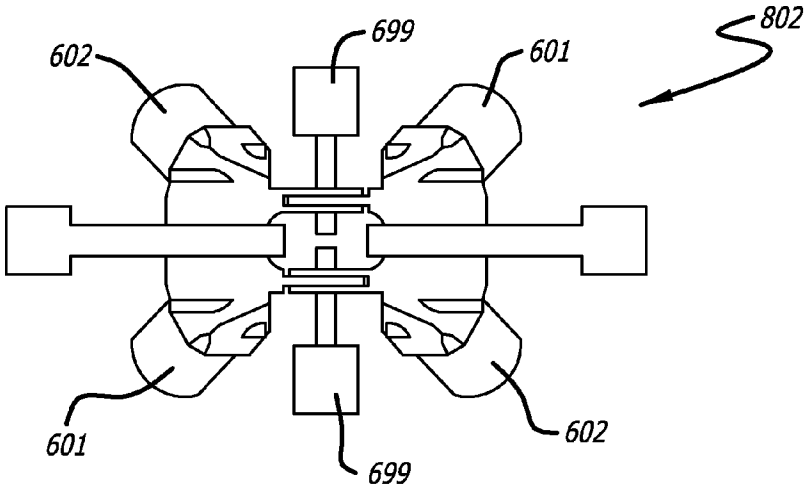
FIG. 12 is a top plan view of joint 802 of FIG. 9.
Figure 17:
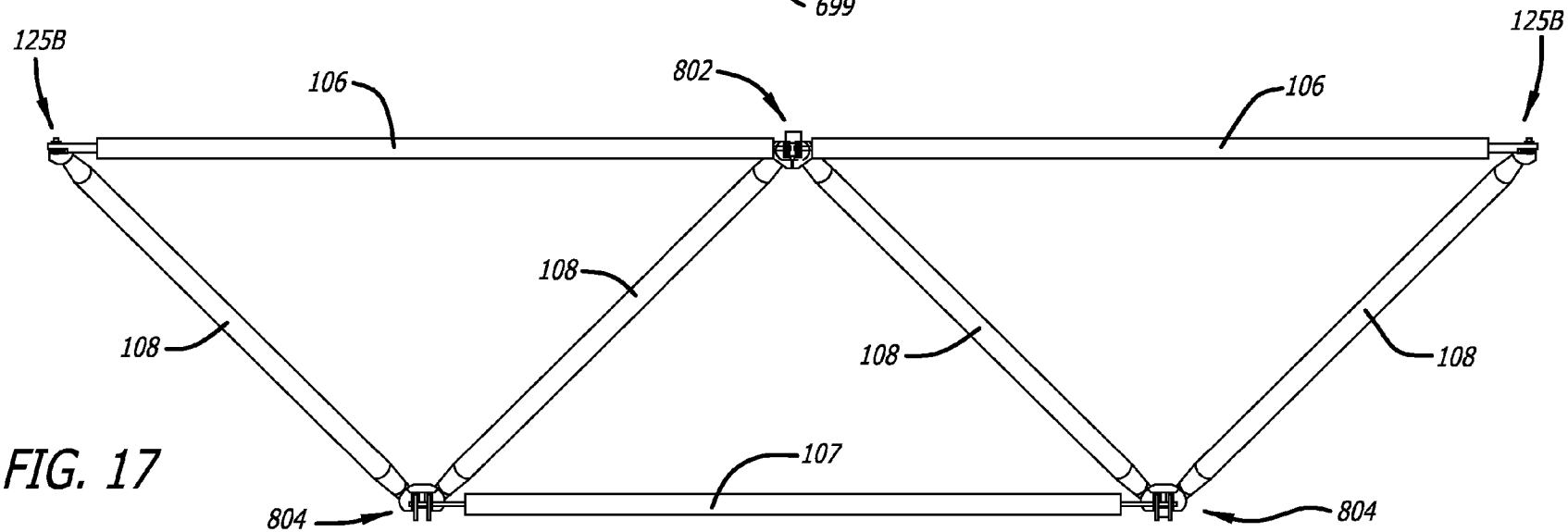
FIG. 17 is an end view of FIG. 9.

The triangular truss beam 100 of FIGS. 1-4 can be uniquely combined to form a double triangular truss beam configuration 800 as shown in FIGS. 9 and 17, where two bays are shown. Like numerals refer to like parts of the configuration of FIGS. 1 to 4. This can be accomplished by mirroring one truss about its C chord such that both trusses use a common C chord. Where the 125C joints are adjacent to each other, they are replaced by a 120 joint, modified to include end fittings 699 as in FIGS. 8A and 8B, as used in the A chords (see FIG. 6A) but having the transverse members on either side connected to the main hinge pins 625. This becomes the 802 joint of FIG. 9 (see the detail in FIG. 12 wherein like numerals refer to like numerals refer to like parts of FIGS. 6A, 6B, 8A and 8B). For structural completeness, the Chord A 120 joints are connected by transverse members 107 (also shown in FIG. 17) similar to members 106, but where each end is connected to the respective main hinge pins 625 of the 120 joints. All other features of the single trusses 100 are retained.

The triangular truss beam described herein may be uniquely derived from the patented basic square/U-shaped truss beam in U.S. Pat. No. 7,028,442 ('442 patent), the teachings of which are incorporated herein by reference.

Figure 13:
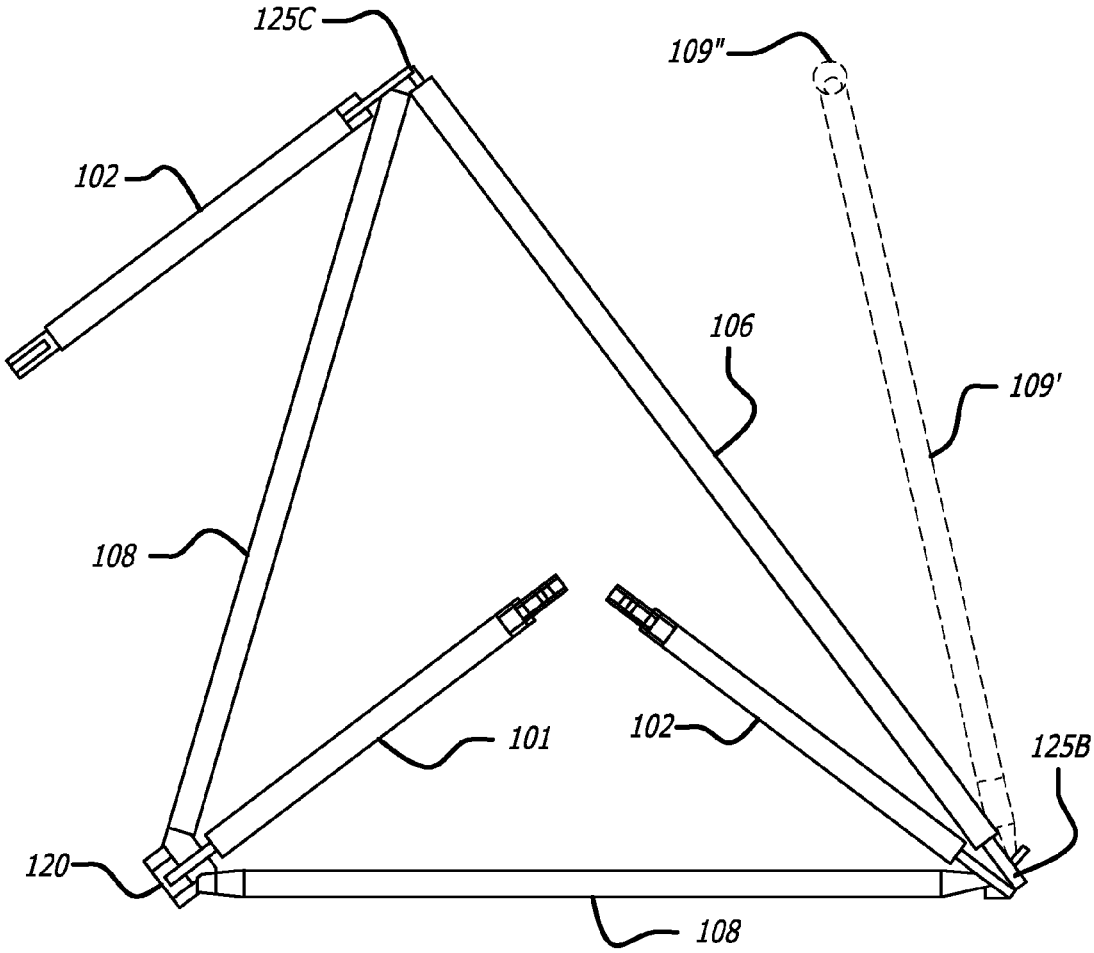
FIG. 13 is a view similar to FIG. 4 illustrating the formation thereof from a frameset in the '442 patent.

Thus, as seen in FIG. 13, the side diagonal 109', shown in dotted lines, and its joint 109", is removed. Folding primary and secondary chordal members 101, 102 are added to the end joints as shown. In the preferred embodiment, transverse members 106 are added, oriented perpendicular to the truss beam longitudinal axis. Optional end frames, not shown, as in the '442 patent, may be used as end close-outs with half-bay end chordal members in the primary chordal member. Optionally, for torsional rigidity, the joints 125B and joints 125C may be connected by flexible cross-diagonal members 200 as previously discussed (see FIG. 3).

Figure 14:
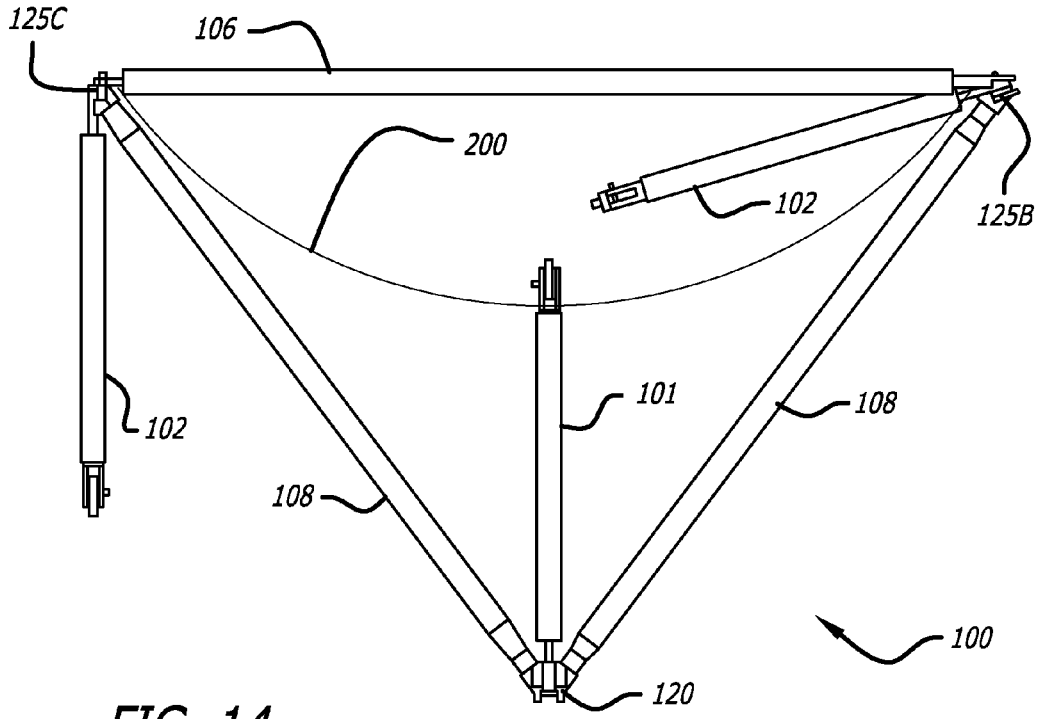
FIG. 14 is a view similar to FIG. 4 showing the truss retracted.
Figure 15:
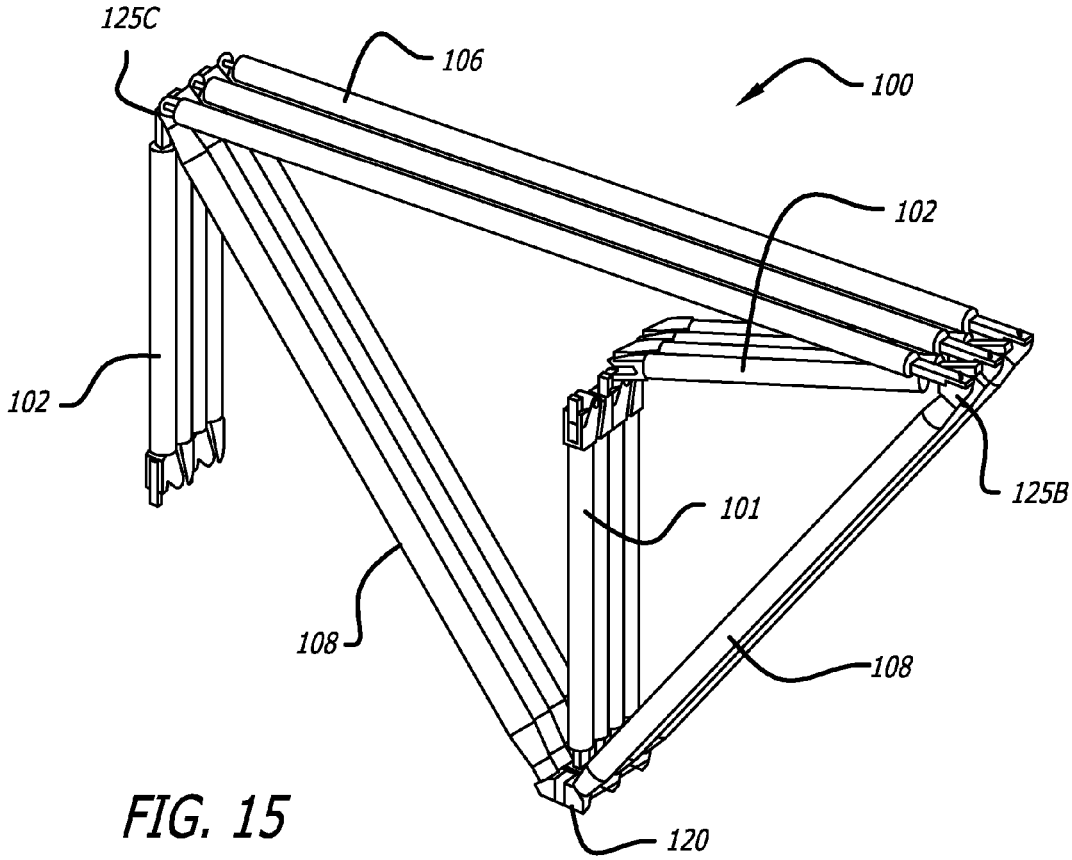
FIG. 15 is a perspective view of two bays in the retracted state.

A retracted triangular truss bay is shown in FIG. 14. When two or more such bays are retracted, as seen in FIG. 15, the folded truss bays nest in parallel fashion, as disclosed in the '442 patent, with a retracted length of about 1/10th to 1/30th of the extended or deployed length. During extension, the pyramidally shaped bays align to each other by the constraint action of the 125B orthogonal joint hinges. With the use of folding chords, the truss motion is fully synchronous as taught in the '442 patent. Without folding chords, the motion is synchronous if the joints adhere to a prescribed contour, e.g., a flat surface, or if the folding chords are powered. The truss may be extended into linear or curved beams, as in FIGS. 5A to 5C, or with circular, parabolic, or other contour, and as a closed ring or ellipse (see ring 900 in FIG. 16). The truss can be curved as shown in FIGS. 5A to 5C by minor modification of only joints 125B and having the vertex chordal members longer or shorter than the "b" and "c" chordal members. Trusses can be connected laterally (FIG. 13) to form linear or curved dual truss beams, in which case additional transverse struts are used to connect the primary joints 120.

Thus, the invention herein expands the utility of the basic invention in the '442 patent by enabling simplified formation of either linear or curved structures, where the structures have a wide face useful for optional deployment of flat panels to serve a specified function.

A truss geometry is created which can be readily used to efficiently form planar area platforms by lateral mating of linear trusses.

Figure 16:
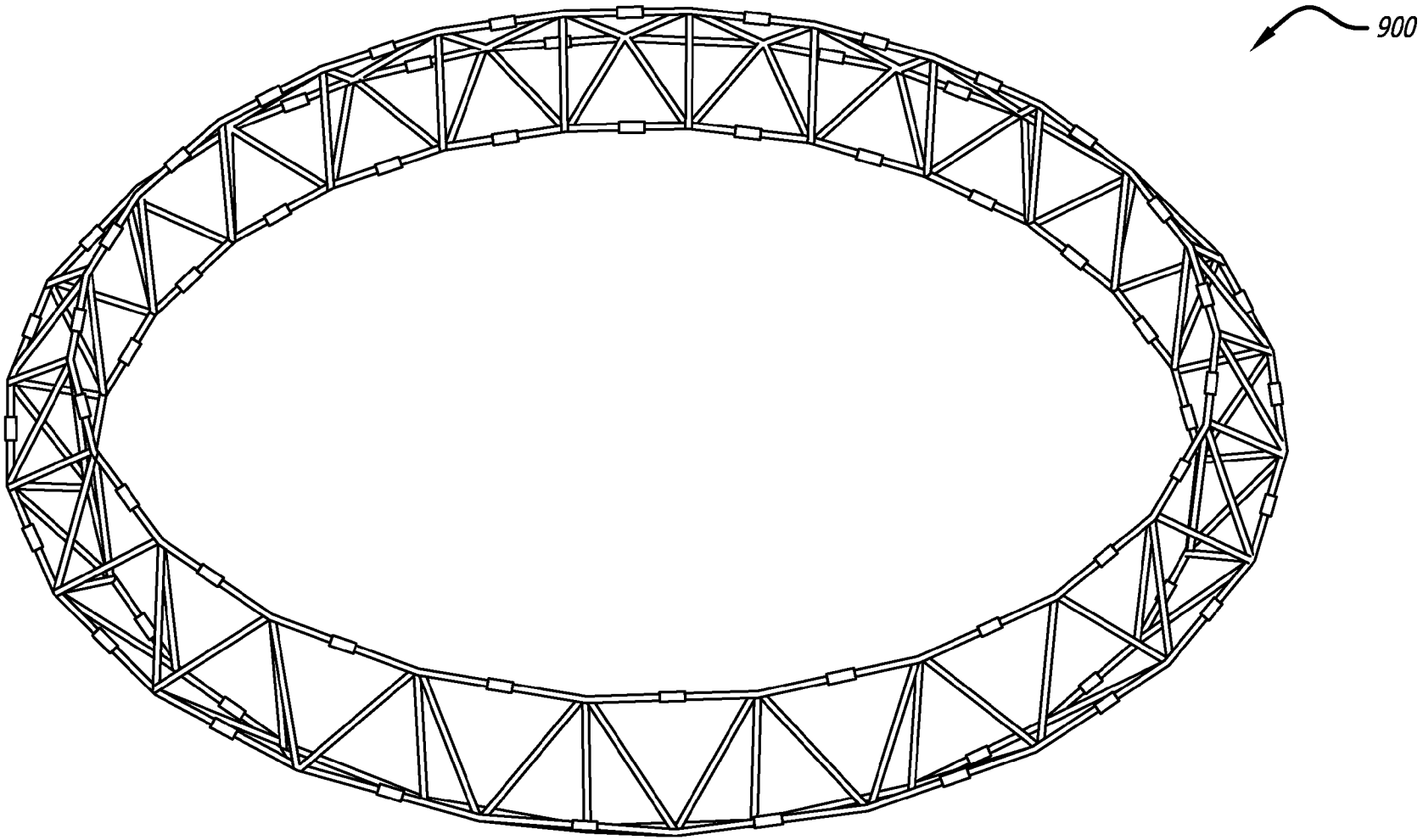
FIG. 16 is a perspective view illustrating the formation of the triangular truss beam of the invention into a perimeter truss configuration.

The number of folding chords required is minimal. A perimeter truss as seen in FIG. 16, can be post-tensioned with only one set of primary folding chordal members.

Truss configurations are created which can be erected/deployed readily into curved beams or perimeters. As closed perimeters, they can be post-tensioned for joint preloading without preloading of individual joints as for trusses of linear or open curved segments.

Referring to FIGS. 1 and 13, there are three orthogonal joint configurations, which connect the framesets defined in FIG. 3. Each joint's main hinge pin axis remains orthogonal to the truss longitudinal axis at all times during extension and retraction.

The joint 120, shown in FIGS. 5, 6A and 6B, is functionally the same as the primary joint in the '442 patent (See FIG. 5 of the '442 patent) and connects 6 truss members. They hingedly connect 2 pairs of diagonals which fold parallel to each other when the truss is retracted. This is shown clearly in FIG. 15.

The joints 125B replace the primary joints in the truss in the patent '442. They have two hinged fittings, which can be derived geometrically by splitting the hinged fittings of joints 120 down their centerlines. These joints are defined as including the end fittings of the chordal struts and transverse members. The latter incorporate spherical bearings to allow 2-axis freedom about the main hinge pin of the hinged fittings when the truss folds. These hinged fittings each connect to a side diagonal, through a rotational joint to permit the necessary orthogonal joint action as in the '442 patent. The diagonals fold parallel to each other as shown in FIG. 15, and the chordal strut fittings and members fold into the same transverse space as the diagonals.

The joints 125C are shown in FIGS. 8A and 8B. When deployed, their hinge pin axes are orthogonal to those of the joints 125B. These joints, like the 125B joints, connect the side diagonals of mating framesets and the ends of the chordal struts. They also connect one end of each transverse member co-linearly to the main hinge pin.

For the dual truss embodiment of FIG. 9, formed by mirroring a single truss about a common "c" chord, the two adjacent 125C joints are replaced by a new joint identical to joint 120.

As shown in FIGS. 5, 5A to 5C, the hinge pin axes of the 120 and 125C joints permit curvature along a prescribed path, typically circular. The 125B joints orthogonally require an additional degree of freedom, which can be provided by a compliant bushing or a spherical bearing within the clevis geometry. This can permit formation of a full 360-degree ring truss if desired, as shown in FIG. 16. The perimeter truss can be preloaded by chordal length adjustment when its free ends are connected, as described above. Flexible cross-diagonals 200 (not shown in FIG. 16) may be provided where desired.

While the invention has been described in detail and with reference to specific embodiments thereof, it will be apparent to those skilled in the art that various changes and modifications can be made therein without departing from the spirit and scope thereof. Thus, it is intended that the present invention cover the modifications and variations of this invention provided they come within the scope of the appended claims and their equivalents.

The invention claimed is:

1. A deployable triangular truss beam with proximal and distal ends, comprising:

a plurality of framesets, each frameset having a first diagonal side member, a second diagonal side member, and a transverse member, each of said diagonal side members and said transverse member having a first and a second end, said first diagonal side member being rigidly connected at its first end adjacent to the first end of said second diagonal side member at a primary joint half and the second end of said first diagonal side member being hingedly connected to the first end of said transverse member at a first secondary joint, the second end of said transverse member being hingedly connected to the second end of said second diagonal side member, at a second secondary joint;

a plurality of framebay subassemblies, each framebay subassembly comprising a first and second frameset, one of said framesets being connected to another of said framesets by a diagonal member connecting the second end of said second diagonal member at its connection to the second end of said transverse member to the primary joint of a first frameset, and said one of said framesets also being connected to another of said framesets by a diagonal member connecting the second end of said first diagonal member at its connection to the first end of said transverse member to the last mentioned primary joint thereby forming a framebay subassembly; and a plurality of framebays, each framebay comprising a framebay subassembly, a first primary folding chordal member connected to the primary joints of the framesets comprising the framebay subassembly, a first secondary folding chordal member connected to the second ends of said first diagonal side members of the first and second framesets comprising the framebay subassemblies at their points of connection to the first ends of said transverse members, and a second secondary folding chordal member connected to the second ends of said second diagonal side members of the first and second framesets comprising the framebay subassemblies at their points of connection to the second ends of said transverse members;

wherein the plurality of framebays when extended form a truss beam with no more than three sides in cross section with three longitudinal chords; and further wherein all of said joints being separable into two interconnected mating parts and having hinge means thereon for folding said chordal members from a first deployed position to a second retracted position.

2. The truss beam of claim 1, further comprising:

said interconnected mating parts of said primary joints each comprising a female half and a male half, said female half comprising two ends, a first end comprising two parallel flanges having aligned holes therethrough and an extension portion spaced from said flanges having a hole therethrough, and a second end comprising a pair of angled connection features for connecting diagonal members, and said male half comprising two ends, a first end comprising two parallel flanges with aligned holes therethrough and an extension portion spaced from said flanges of said male half, said extension portion of said female half being received between the flanges of said male and the extension portion of said male half being received between the flanges of said female half, and a hinge pin extending through the holes in said extension portions and said flanges of said male and female halves for providing a hinged connection, and said male half also having a second end comprising a pair of angled connection features for connecting diagonal members, and each half of said primary joints having a linearly extending connection extending outwardly therefrom between said angled connections for said diagonal members of said primary joints for connecting said primary chordal members thereto;

said interconnected mating parts of said secondary joints each comprising a female half and a male half, said female half comprising two ends, a first end comprising a pair of spaced apertured flanges receiving therein an aperture extension portion of said male half, and a hinge pin extending through said apertures for providing a hinged connection, each half of said secondary joints having a second end comprising a single angled fitting for rigidly connecting a diagonal member, and each half of said secondary joints having a linearly extending connection extending outwardly therefrom between said angled connections for said diagonal members of said secondary joints for connecting said secondary chordal members thereto; and further wherein said truss beam, when extended to its deployed position, forms a triangular shape in cross section with a first, second and third side, with a primary chordal member extending through the apex corner of said triangular shape, and with a first and second secondary chordal member extending through the spaced ends forming the base of said triangular shape, said primary chordal member connected by a plurality of side diagonal members to each of said first and second secondary chordal members thereby forming the sides of said triangular shape, and a plurality of transverse members interconnecting said first and second secondary chordal members thereby forming the base of said triangular shape.

3. The truss beam of claim 2, wherein each of said chords is comprised of a plurality of chordal members interconnected by a folding hinge, whereby said chordal members fold from a first deployed position to a second retracted position.

4. The truss beam of claim 3, wherein the folding hinges of said primary chordal members lock at full deployed extension of said truss beam.

5. The truss beam of claim 4, wherein a plurality of flexible members interconnect one of said joints to another to provide tensile strength to said truss beam.

6. The truss beam of claim 1, wherein said diagonal members are adapted to be selectively rotated relative to their connections or are rotatably connected to said first primary joints.

7. The truss beam of claim 1, wherein said diagonal members comprise rigid portions rotatably connected.

8. The truss beam of claim 1, wherein respective framesets are adapted to retract and deploy in a coordinated, synchronous manner through action of the joints wherein the axis of the hinge connections of said joints remain orthogonal to the truss longitudinal axis.

9. The truss beam of claim 1, further wherein the mating portions of said joints each comprise a male and female half, the male half of a primary joint being designed to fit with the female half of said primary joint, and the male half is hingedly connected to the female half by a main hinge pin inserted through matching holes in the each half.

10. The truss beam of claim 9, further wherein the axes of the hinge connections between the halves of said primary and secondary joints are orthogonal to each other when the truss beam is at full extension.

11. The truss beam of claim 9, further wherein the axes of the hinge connections between the halves of each primary joint are co-planar and parallel with the axes of the hinge connections between each half of said primary joint and the primary chordal member when the truss is at full extension.

12. The truss beam of claim 1, further wherein the corresponding diagonal members of adjacent framesets nest parallel and adjacent to each other when the truss beam is fully collapsed.

13. The truss beam of claim 1, further wherein the corresponding chordal members of adjacent framesets nest parallel and adjacent to each other and in the same transverse space as the diagonal members when the truss beam is fully collapsed.

14. The truss beam of claim 1, wherein the mating parts of said joints each comprise a male and female half, the male and female halves of said primary joints each comprising means for connecting to one end of the primary chordal member, and the male and female halves of said secondary joints each comprising means for connecting to one end of a secondary chordal member.

15. The truss beam of claim 1, further wherein the mating parts of said joints each comprise a male and female half, the angled connection of the second end of the female half of said primary joints being co-planar, and the angled connection features of the second end of the male half of said primary joints being co-planar.

16. The truss beam of claim 1, wherein the transverse members are not hinged in or near their midpoint.

17. The truss beam of claim 1, wherein only chordal members are hinged in or near their midpoint.

* * * * *